US011101083B2

(12) United States Patent
Rabb et al.

(10) Patent No.: US 11,101,083 B2
(45) **Date of Patent: *Aug. 24, 2021**

(54) ELECTRICAL SWITCH

(71) Applicant: ABB Schweiz AG, Baden (CH)

(72) Inventors: Patrik Rabb, Vaasa (FI); Rainer Kolmonen, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/820,176

(22) Filed: Mar. 16, 2020

(65) Prior Publication Data

US 2020/0219671 A1 Jul. 9, 2020

Related U.S. Application Data

(63) Continuation of application No. PCT/FI2018/050661, filed on Sep. 13, 2018.

(30) Foreign Application Priority Data

Sep. 15, 2017 (FI) ..... U20174214

(51) Int. Cl.
*H01H 1/20* (2006.01)
*H01H 1/58* (2006.01)
(Continued)

(52) U.S. Cl.
CPC ..... *H01H 1/2041* (2013.01); *H01H 1/5822* (2013.01); *H01H 9/02* (2013.01); *H01H 9/362* (2013.01); *H01H 2009/0292* (2013.01)

(58) Field of Classification Search
CPC ..... H01H 1/2041; H01H 1/5822; H01H 9/02; H01H 9/342; H01H 19/38; H01H 19/42;
(Continued)

(56) References Cited

U.S. PATENT DOCUMENTS 3,167,620 A 1/1965 Keyser et al.
3,566,056 A * 2/1971 Joseph ..... H01H 31/026 200/48 A
(Continued)

FOREIGN PATENT DOCUMENTS

CH 330629 A 6/1958
CN 102804295 * 11/2012 ..... H01H 1/42
(Continued)

OTHER PUBLICATIONS

Translation of CN 102804295 ABS (Original doc, published Nov. 28, 2012) (Year: 2012).*
(Continued)

*Primary Examiner* — William A Bolton
(74) *Attorney, Agent, or Firm* — Taft Stettinius & Hollister LLP

(57) ABSTRACT

The electrical switch includes a first and a second fixed contact, and a rotatable knife contact including at least one pair of blades being flexibly connected to each other and rotating around a rotational axis. A third fixed contact is positioned on an opposite side of the rotational axis in relation to the adjacent first and second fixed contact and a middle portion of the rotatable knife contact is electrically connected to the third fixed contact. The rotatable knife contact connects in a first switching position the first fixed contact and in a second switching position the second fixed contact to the third fixed contact.

20 Claims, 7 Drawing Sheets

Figure 1:
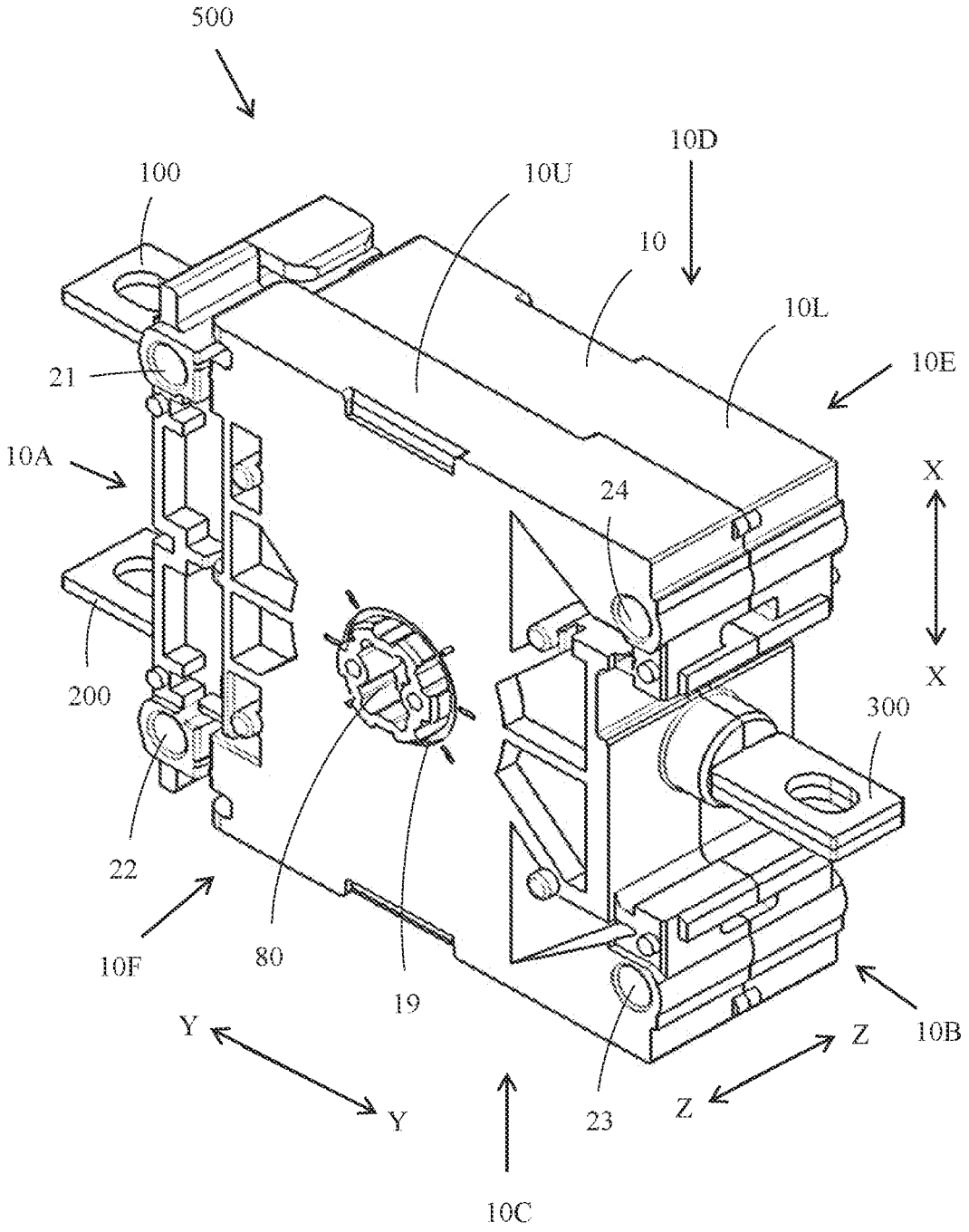

(51) Int. Cl.
*H01H 9/02* (2006.01)
*H01H 9/36* (2006.01)

(58) Field of Classification Search
CPC ..... H01H 19/46; H01H 19/50; H01H 71/08; H01H 73/18; H01H 33/20; H01H 1/205; H01H 1/2058; H01H 1/365; H01H 9/64; H01H 73/045
USPC ..... 200/11 R, 15, 16 F, 18, 19.03, 19.07, 200/19.18, 48 KB, 48 A, 48 V, 48 CB, 200/50.34, 50.39, 410, 554; 218/100, 218/101, 12, 45
See application file for complete search history.

(56) References Cited

U.S. PATENT DOCUMENTS 4,090,046 A * 5/1978 Faust ..... H01H 1/42 200/15
4,791,255 A 12/1988 Eliezer
4,849,590 A * 7/1989 Becker ..... H01H 1/54 218/33
5,969,308 A 10/1999 Pever
6,023,036 A 2/2000 Nichols
6,313,416 B1 * 11/2001 Abroy ..... H01H 1/42 200/15
6,538,223 B1 * 3/2003 Yoshida ..... H01H 21/42 200/1 R
6,815,624 B2 * 11/2004 Schultz ..... H01H 9/0066 200/50.33
2012/0090972 A1 4/2012 Yoshida et al.
2014/0218140 A1 8/2014 Dolinski et al.

FOREIGN PATENT DOCUMENTS

CN 204390924 U 6/2015
WO 2014170529 A1 10/2014

OTHER PUBLICATIONS

Finnish Patent Office, International Search Report & Written Opinion issued in corresponding Application No. PCT/FI2018/050661, dated Dec. 19, 2018, 25 pp.
European Patent Office, Extended Search Report issued in corresponding Application No. 18855281.4, dated Sep. 22, 2020, 11 pp.

* cited by examiner

ELECTRICAL SWITCH

FIELD

The invention relates to an electrical switch.

BACKGROUND

There are a variety of electrical switches on the market with fixed and movable contacts. The movable contacts make connections between the stationary contacts. The electrical switch can, in its simplest case, only have two fixed contacts and one movable contact that performs coupling and disconnection between these two fixed contacts. On the other hand, the electrical switch can be a so-called transfer switch, which can include three fixed contacts. The transfer switch can comprise two switching states such that in the first switching state the first fixed contact is connected to the third fixed contact and in the second coupling mode, the second fixed contact is connected to the third fixed contact. The transfer switch can further comprise a third state i.e. a zero state in which all three fixed contacts are isolated from each other. The transfer switch can be used in a situation where it is necessary to connect the load to a primary power supply or to a secondary power supply. Such a need is for example in hospitals where the primary power supply is the electrical grid and the secondary power supply is an emergency power plant. The load is thus coupled to the third fixed contact and the primary power source to the first or second fixed contact and the secondary power source respectively to the second or the first fixed contact.

The electrical switches can be provided with bumper contacts or knife contacts. The contact in the bumper contact structure is pressed to the fixed contacts. In the knife contacts, the movable contact consists of two blades hinged at one end to a fixed contact and the other end acts as a separating part. The knife contact construction can also be implemented with two openings so that the blades are connected to a rotating roller or so that the blades move straight up and down. The knife contacts are normally used in switches designed for a nominal current over 63 ampere and bumper contacts are used in switches designed for smaller currents.

SUMMARY

The invention relates to an improved electrical switch.

The electrical switch according to the invention is defined in claim 1.

The electrical switch comprises:

a first fixed contact, a second fixed contact, a rotatable knife contact having a rotational axis and comprising at least one longitudinal pair of blades flexibly connected to each other, whereby the blades form, in a switching event, contact with contact portions of the first and/or the second fixed contact.

The electrical switch is characterized in that a third fixed contact is positioned on an opposite side of the rotational axis of the rotatable knife contact in relation to the first and the second fixed contact being adjacent to each other, a middle portion of the rotatable knife contact is electrically connected to the third fixed contact in all positions of the rotatable knife contact, whereby the rotatable knife contact connects in a first switching position the first fixed contact and in a second switching position the second fixed contact to the third fixed contact.

The electrical switch is a transfer switch in which both ends of the rotatable knife contact are utilized alternatively in the switching operation.

The third fixed contact may be connected with a permanent electrical connection to the middle portion of the rotatable knife contact. Both ends of the blades in the rotatable knife contact are thus free to form switching. The pole of the transfer switch may thus be realized with one rotatable knife contact and two separate contact chambers.

Several parallel pairs of blades may be provided in the rotating knife contact of the electric switch.

The blades in each pair of blades in the rotatable knife contact may be connected flexibly to each other so that the blades due to a separating force acting on either end of the blades can take a V-shape. An increase of the distance between the first end of the blades leads to a decrease of the distance between the second end of the blades and vice a versa.

An outwardly protruding area may be provided on an inner surface of each blade at a distance from an outer tip of the blade in the pair of blades of the rotatable knife contact. The outwardly protruding area may alternatively be provided on opposite outer surfaces of the contact portion of the first and the second fixed contact. The outwardly protruding area will cause the separating force of the blades when the rotatable knife contact makes contact with the first or second fixed contact.

The nominal current in the continuous switching position flows thus only through the outwardly protruding areas between the blades of the rotatable knife and the first or second fixed contact. There are thus two separate functional areas in the blades of the rotatable knife contact and the first or second fixed contacts. A first area at the tip of the contacts for initial switching and a second area at a distance from the tip of the contacts for nominal current in the continuous switching position.

The third fixed contact may have a T-shape or an L-shape. This means that a free joint surface is formed on the horizontal arm of the third fixed contact within the housing. A braided cable may thus be used to connect the third fixed contact to the rotatable knife contact. One end of the braided cable may be attached to the free joint surface on the horizontal arm of the third fixed contact by welding, soldering or with a pressure joint and the other end of the braided cable may be attached to the middle portion of the rotatable knife contact by welding, soldering or with a pressure joint.

The attachment of the braided cable to the horizontal branch of the third fixed contact, makes it possible to use a longer braided cable which means that more play for the braided cable is achieved. A flexible joint that withstands well movement of the fourth contact is thus achieved between the third fixed contact and the fourth rotatable knife contact. Thus, the third fixed contact and the rotatable knife contact are electrically connected through the braided cable in all positions of the rotatable knife contact.

By forming the third fixed contact into a T-shape or L-shape, a support surface can be formed inside the housing against which the horizontal arm of the third fixed contact can be supported. The third fixed contact can thus be secured firmly to the housing.

The horizontal arm of the third fixed contact inside the housing also allows for temperature measurement of the horizontal arm. An opening can be provided in the housing wall from the outer surface of the housing wall through the support surface to the horizontal arm. The temperature sensor can thus be connected from the outside of the housing to the horizontal axis. The temperature of the horizontal arm inside the housing can be measured at the point where the braided cable is or the braided cables are attached to the horizontal arm i.e. from the most critical point. The temperature measurement thus indicates the condition of the joint between the third fixed contact inside the housing and the braided cable.

DRAWINGS

Figure 2:
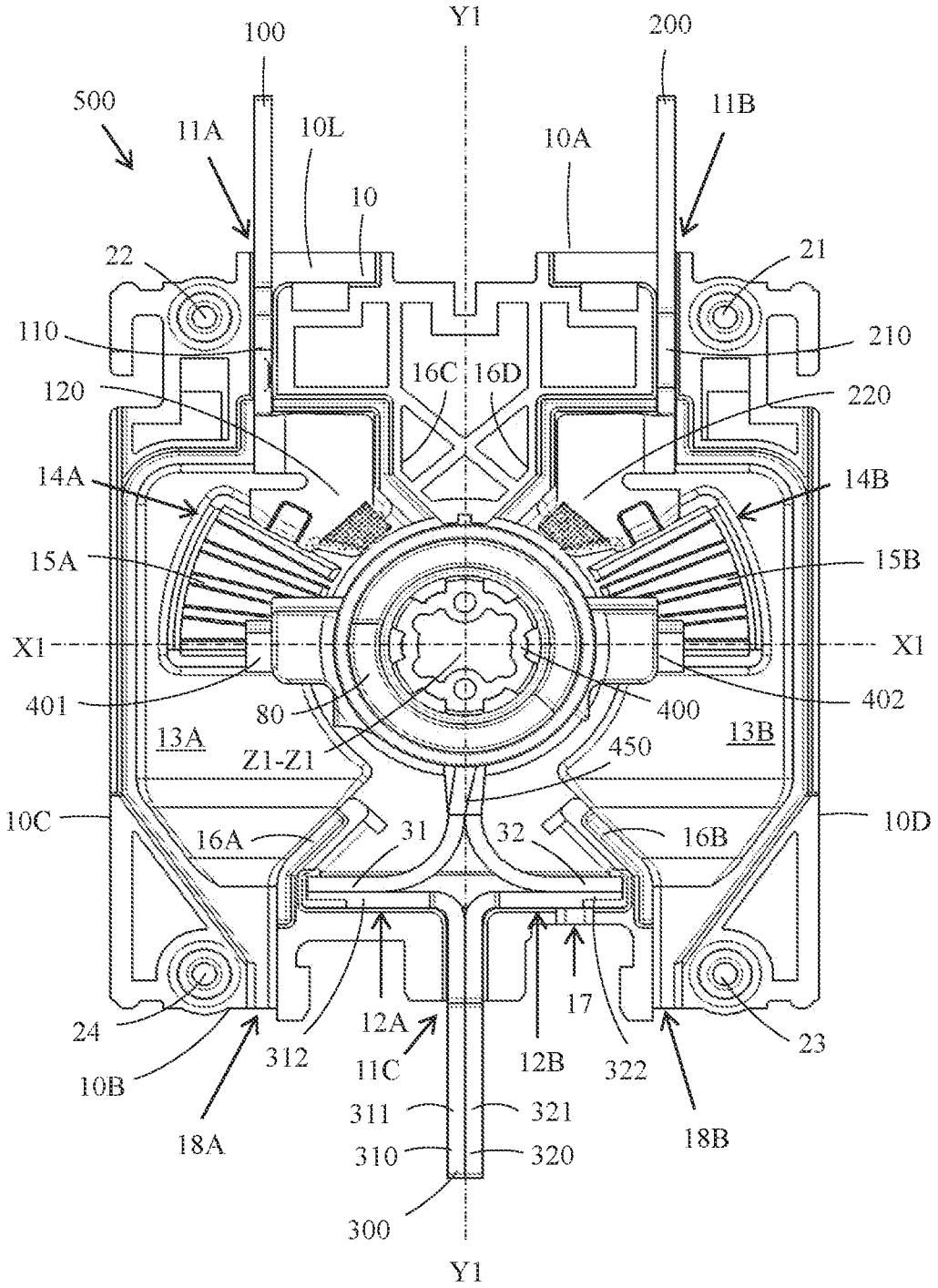
Figure 3:
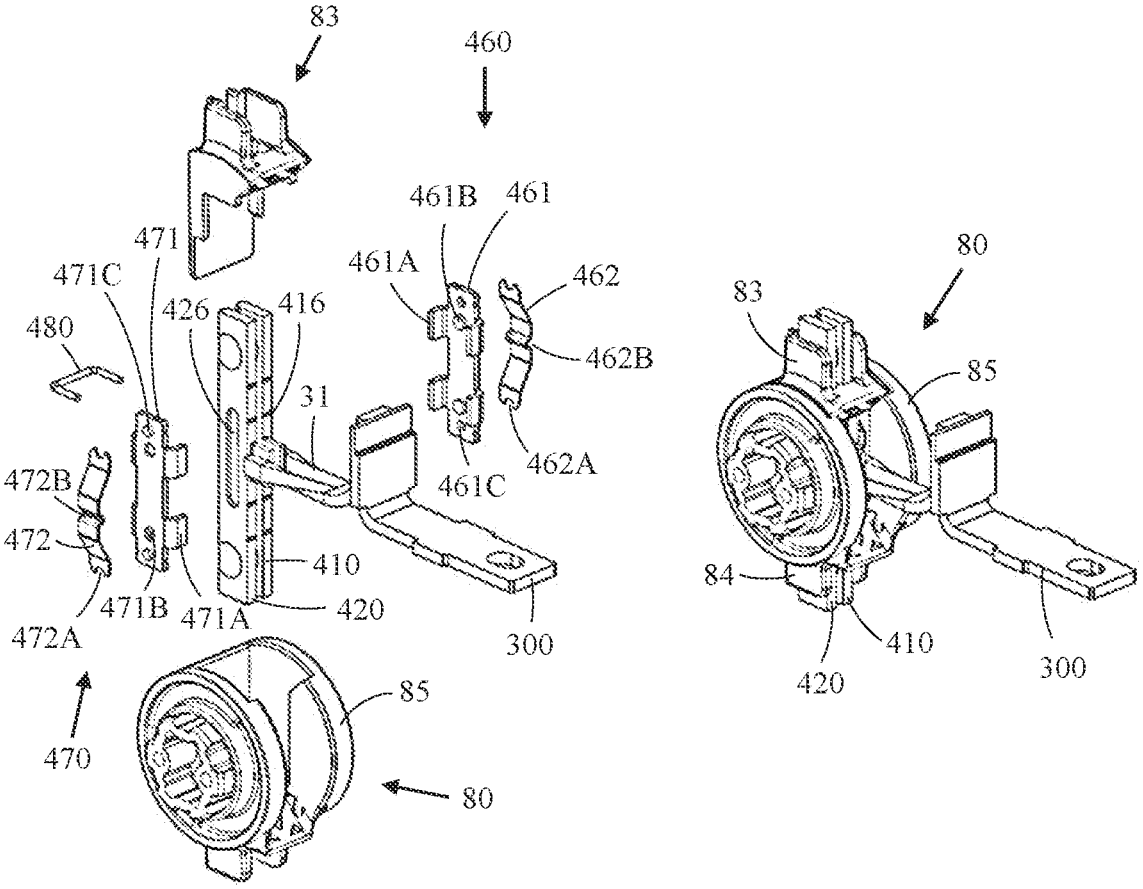
Figure 4:
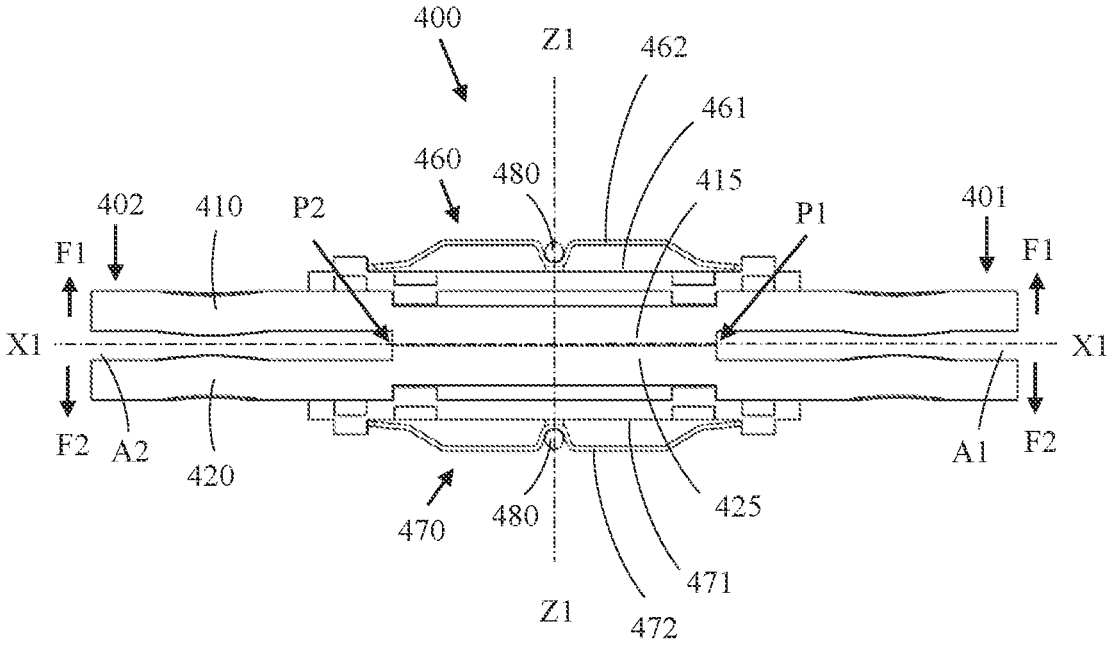
Figure 5:
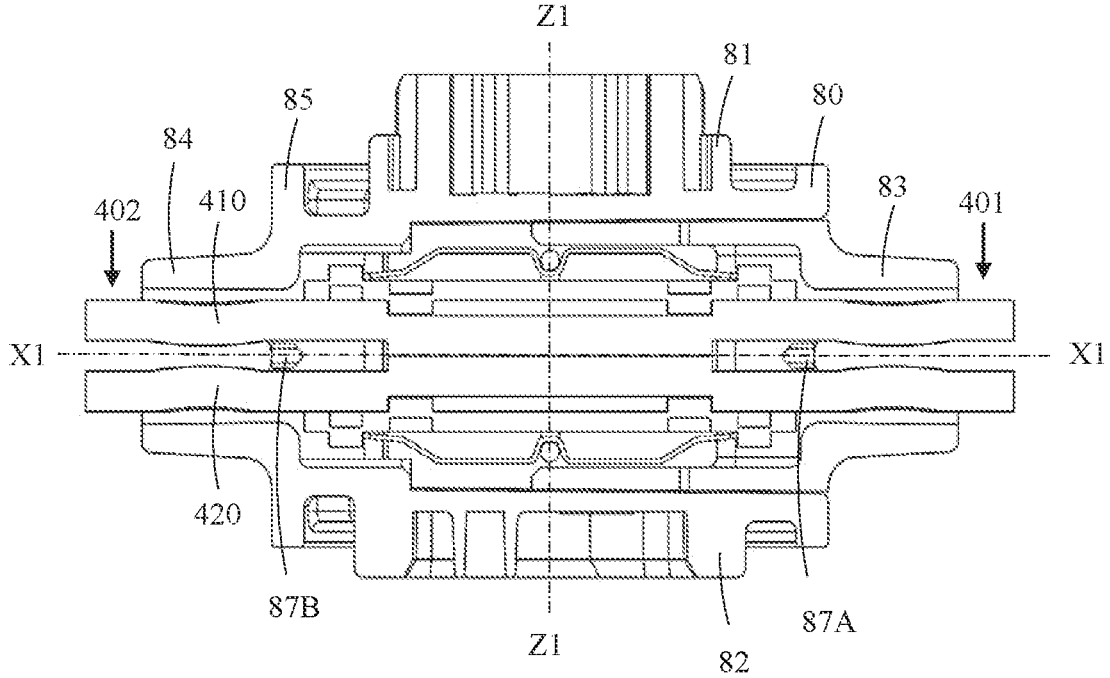
Figure 6:
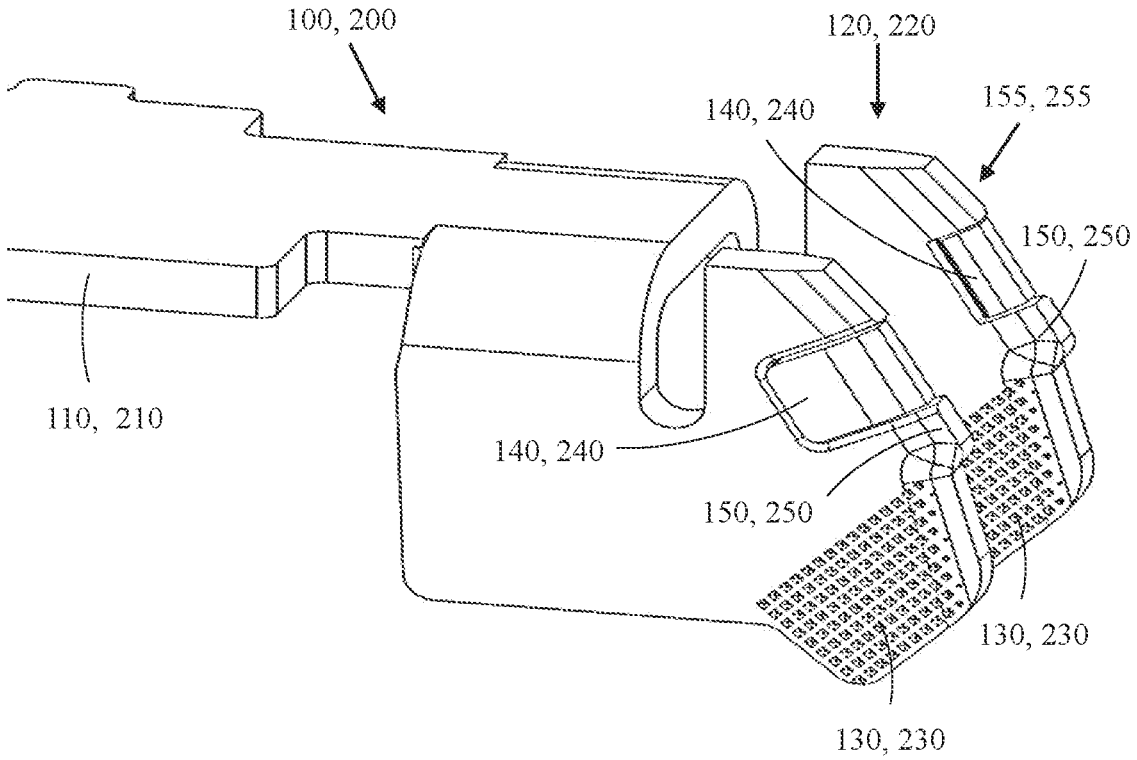
Figure 7:
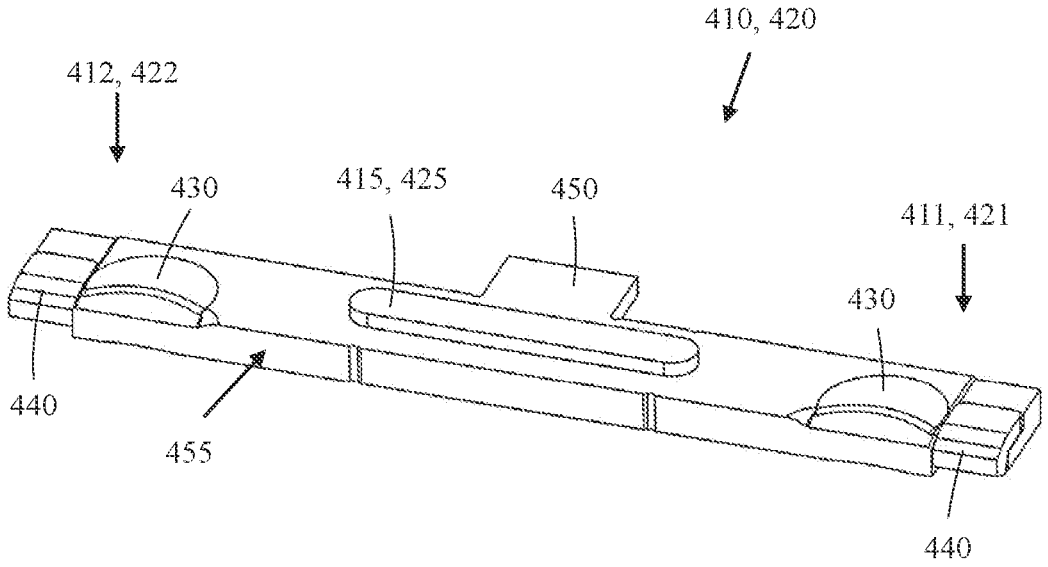
Figure 8:
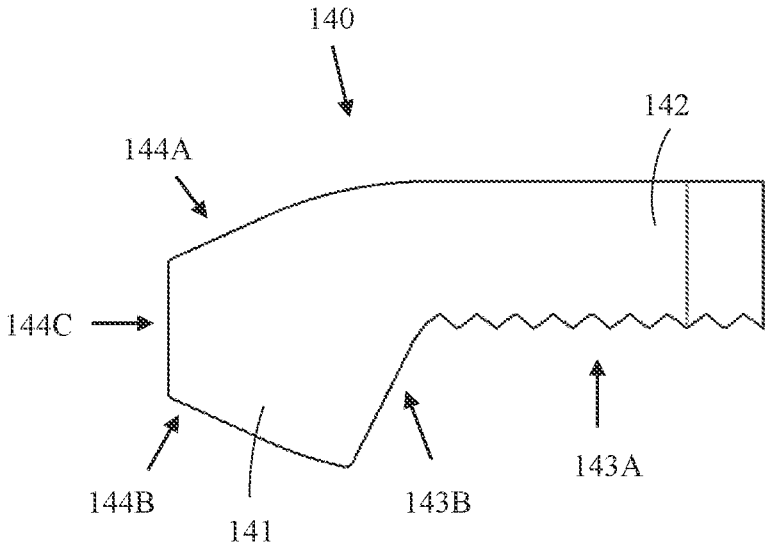
Figure 9:
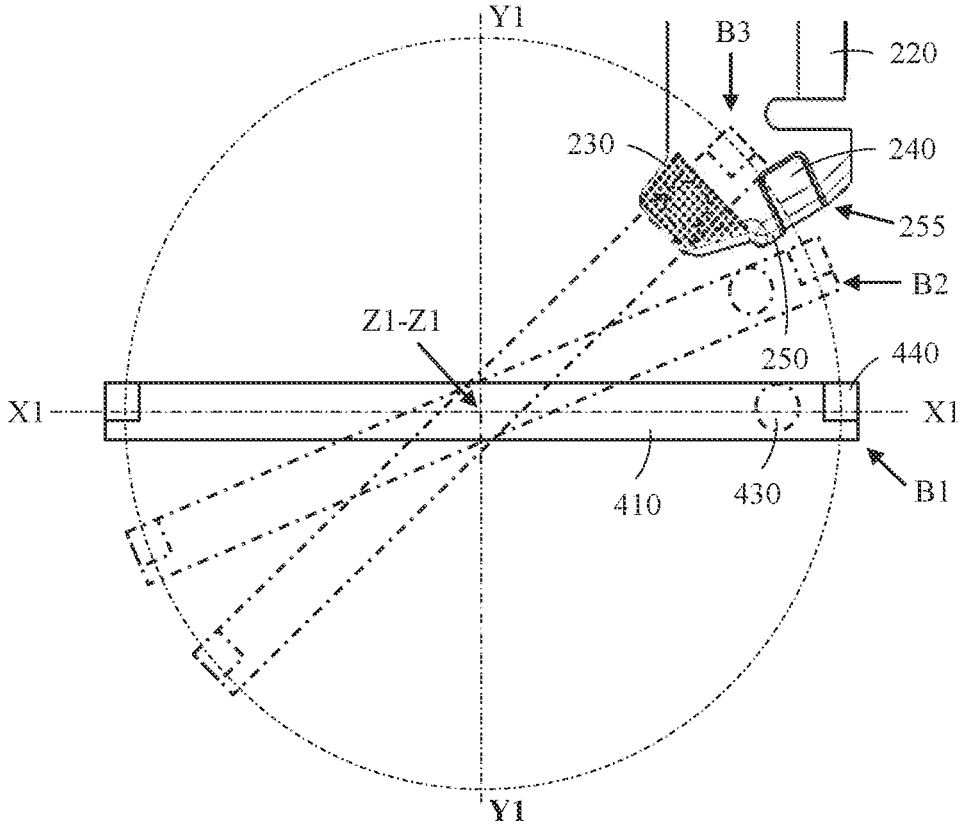
Figure 10:
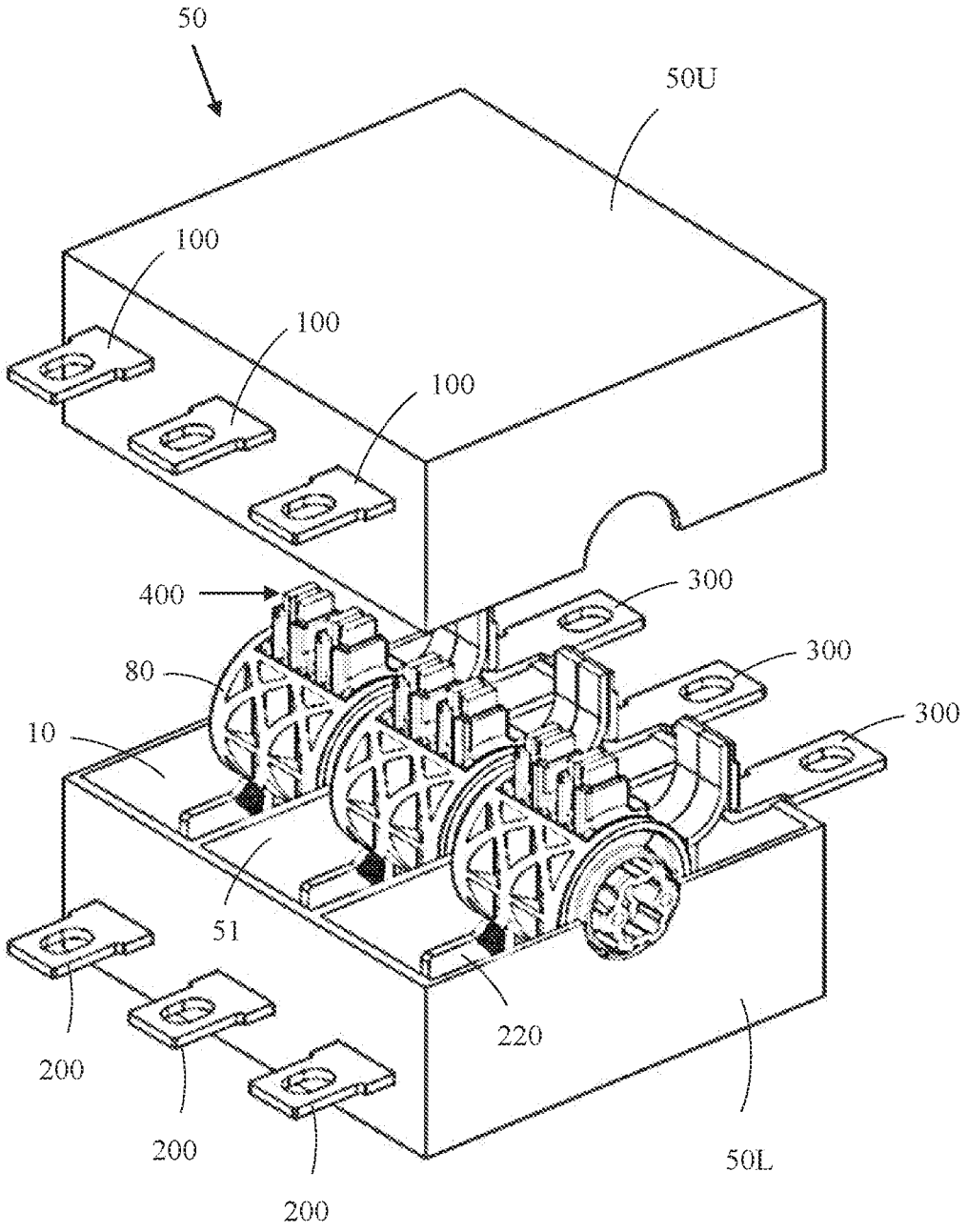

The invention will be described with reference to the accompanying drawings in which FIG. 1 shows an axonometric view of an electrical switch, FIG. 2 shows the electrical switch with the upper half of the housing being removed, FIG. 3 shows an exploded view of a rotatable knife contact and a roller of the electrical switch, FIG. 4 shows a rotatable knife contact of the electrical switch, FIG. 5 shows a rotatable knife contact and a roller of the electrical switch, FIG. 6 shows a fixed contact of the electrical switch, FIG. 7 shows a blade of a rotatable knife contact of the electrical switch, FIG. 8 shows a contact pin of a contact of the electrical switch, FIG. 9 shows a fixed contact and a rotatable knife contact of the electrical switch, FIG. 10 shows a non-modular three phase electrical switch.

DETAILED DESCRIPTION

FIG. 1 shows an axonometric view of an electrical switch.

The electric switch 500 comprises a housing 10 having a longitudinal direction Y-Y, a height direction X-X perpendicular to the longitudinal direction Y-Y, and a thickness direction Z-Z perpendicular to the longitudinal direction Y-Y and to the height direction X-X. The height direction X-X and the thickness direction Z-Z form transverse directions in relation to the longitudinal direction Y-Y of the housing 10.

The housing 10 consists of two halves 10L and 10U. The first half 10L of the housing 10 is placed against the second half 10U of the housing 10 so that a substantially closed space is formed within the two halves 10L, 10U. Each half 10L of the housing 10 comprises a side panel 10E, 10F and side walls 10A, 10B, 10C, 10D extending perpendicularly from the peripheral edges of the side panels 10E, 10F. The outer edges of the side walls 10A, 10B, 10C, 10D of the halves 10L, 10U of the housing 10 are placed against each other when the halves 10L, 10U of the housing 10 are joined together. The outer edges of the side walls 10A, 10B, 100, 10D of the halves 10L, 10U of the housing 10 may comprise nested projections, whereby the joint between the two halves 10L, 10U of the housing 10 can be made to sustain the pressure caused by arcs within the housing 10.

A first side wall 10A and a second side wall 10B of the housing 10 are positioned spaced apart from each other in a longitudinal direction Y-Y of the housing 10. The first side wall 10A and the second side wall 10B are positioned opposite to each other. The first and the second side walls 10A, 10B extend in the height direction X-X and in the thickness direction Z-Z of the housing 10.

A third and a fourth side wall 10C, 10D connect the edges of the first side wall 10A and the second side wall 10B. The third side wall 10C and the fourth side wall 10D are positioned opposite to each other. The third and the fourth side wall 10C, 10D extend in the longitudinal direction Y-Y and in the thickness direction Z-Z of the housing 10.

The side panels 10E, 10F are positioned spaced apart from each other in the thickness direction Z-Z of the housing 10. The side panels 10E, 10F connect the opposite edges of the side walls 10A, 10B, 100, 10D. The side panels 10E, 10F extend in the longitudinal direction Y-Y and in the height direction X-X of the housing 10.

Each half 10L, 10U of the housing 10 is also provided with mounting holes 21, 22, 23, 24 extending through the housing 10. The two halves 10L, 10U of the housing 10 may be secured to each other with mounting bolts and nuts extending through these fastening openings 21, 22, 23, 24. The first half 10L and the second half 10U of the housing 10 may further have adjustment means or adjustment surfaces for adjusting the two halves 10L, 10U in a correct position in relation to each other.

A first fixed contact 100, a second fixed contact 200, and a third fixed contact 300 is provided in the housing 10. Each of these three fixed contacts 100, 200, 300 is connectable to an external electrical circuit with respect to the housing 10. The housing 10 is further provided with a rotatable knife contact 400 positioned wholly in the interior of the housing 10. The rotatable knife contact 400 is mounted on a roller 80 having a second end protruding out from an opening 19 in the side plane 10F of the housing 10. The rotatable knife contact 400 is shown in FIG. 2.

The cross section of the housing 10 may be substantially rectangular.

FIG. 2 shows the electrical switch with the upper half of the housing being removed.

The figure shows a cross section of a first half 10L of the housing, whereby the figure shows the position of the first fixed contact 100, the second fixed contact 200, the third fixed contact 300, and the rotatable knife contact 400 within the housing 10. The figure shows a longitudinal center line Y1-Y1 and a transverse center line X1-X1 of the housing 10.

The first fixed contact 100 comprises a substantially straight connection portion 110 and a contact portion 120 within the housing 10. The connection portion 110 of the first fixed contact 100 extends along a first connecting channel from the inside to the outside of the housing 10 through a first opening 11A in the first side wall 10A of the housing 10. The first connecting channel is constituted of a groove half in each half 10L, 10U of the housing 10, which groove halves are positioned opposite to each other to form the first connecting channel when the halves 10L, 10U of the housing 10 are joined together. The connection portion 110 of the first fixed contact 100 can thus be connected to an external electrical circuit with respect to the housing 10. The contact portion 120 of the first fixed contact 100 is formed as a plate-like contact surface. The contact is thus formed from both opposing surfaces of the contact portion 120.

The second fixed contact 200 comprises in a similar way a substantially straight connection portion 210 and a contact portion 220 within the housing 10. The connection portion 210 of the second fixed contact 200 extends along a second connecting channel from the inside to the outside of the housing 10 through a second opening 11B in the first side wall 10A of the housing 10.

The second connecting channel is formed of a groove half in each half 10L, 10U of the housing 10, which groove halves are positioned opposite to each other to form the second connection channel when the halves 10L, 10U of the housing are joined together. The connection portion 210 of the second fixed contact 200 can thus be connected to an external electrical circuit with respect to the housing 10. The contact portion 220 of the second fixed contact 200 is formed as a plate-like contact surface. The contact is thus formed from both opposing surfaces of the contact portion 220.

The first fixed contact 100 and the second fixed contact 200 are positioned adjacent to each other within the housing 10 on opposite sides of the longitudinal center line Y1-Y1 of the housing 10. The connection portion 110 of the first fixed contact 100 and the connection portion 210 of the second fixed contact 200 may be parallel and extend essentially in the longitudinal direction Y-Y of the housing 10.

The third fixed contact 300 is, in this embodiment, formed by two L-shaped pieces 310, 320 forming together a T-shaped body. The horizontal arms 312, 322 of the two L-shaped bodies 310, 320 point in opposite directions and the vertical arms 311, 321 of the two L-shaped bodies 310, 320 are clamped against each other back to back. The horizontal arm 312 of the first L-shaped body 310 may be seated against a first support surface 12A inside the housing 10. The horizontal arm 322 of the second L-shaped body 320 may be seated against a second support surface 12B inside the housing 10. The vertical arms 311, 321 of the L-shaped bodies 310, 320 extend along a third connection channel from the inside to the outside of the housing 10 through a third opening 110 in the second side wall 10B of the housing 10. The third connection channel is formed of a groove half in each half 10L, 10U of the housing 10, which groove halves are positioned opposite to each other to form the third connection channel when the halves 10L, 10U of the housing 10 are joined together. The connection portion of the third fixed contact 310, 320 formed by the vertical arms 311, 321 may thus be connected to an electric circuit outside the housing 10.

The third fixed contact 300 is thus located on the opposite side of the housing 10 in respect of the first and the second fixed contacts 100, 200. The first support surface 12A and the second support surface 12B may extend in the height direction X-X of the housing 10. The horizontal arm 312, 322 of each of the L-shaped bodies 310, 320 has an outwardly from the housing 10 directed face, which seats against the respective support surface 12A, 12B of the housing 10 and a free surface directed to the interior of the housing 10.

The vertical arms 311, 321 of each of the L shaped bodies 310, 320 of the third fixed contact 300 may extend substantially in the longitudinal direction Y-Y of the housing 10.

The horizontal arm 312 of the first L shaped body 310 of the third fixed contact 300 is connected by at least one first braided cable 31 to a middle portion 450 of the rotatable knife contact 400. The horizontal arm 322 of the second L-shaped body 320 of the third fixed contact 300 is connected by at least one second braided cable 32 to the middle portion 450 of the rotatable knife contact 400. The braided cables 31, 32 are attached to the free surface directed towards the interior of the housing 10 of the horizontal arm 312, 322 of the L-shaped body 310, 320. The middle portion 450 of the rotatable knife contact 400 may be provided with a protrusion for attaching the braided arms 31, 32. The braided cables 31, 32 form an electrical connection between the third fixed contact 300 and the rotatable knife contact 400.

A measurement aperture 17 may be provided in the second side wall 10B of the housing 10. The measurement aperture 17 extends through the second side wall 10B of the housing 10 and through the second support surface 12B to the horizontal arm 322 of the third fixed contact 320. A temperature sensor may be attached from the measurement aperture 17 to the surface of the horizontal arm 322 of the third fixed contact 320 that is seated against the second support surface 12B. The temperature of the portion of the third fixed contact 320 that is inside the housing 10, i.e. the horizontal arm 322, can thus be measured from the point where the joint between the horizontal arm 322 of the third fixed contact 320 and the braided cable 32 is located. At a specified load current, the temperature in the joint remains stable, whereby a change in the temperature indicates a problem at the joint. In the case of two L-shaped pieces or one T-shaped piece, it is sufficient to measure the temperature only in one of the second horizontal arms, because also a problem in the joint in the opposite horizontal arm is displayed at the measuring point when a larger part of the current attempts to pass through the intact joint.

The rotatable knife contact 400 comprises at least one longitudinal pair of blades 410, 420 with two opposite outer ends 401, 402. The rotatable knife contact 400 rotates in respect of the housing 10 around a rotational axis Z1-Z1. The rotatable knife contact 400 may be turned between a first switching position and a second switching position. A first outer end 401 of the rotatable knife contact 400 makes, in the first switching position, contact to the first fixed contact 100, whereby an electrical connection is formed between the first fixed contact 100 and the third fixed contact 300. A second outer end 402 of the rotatable knife contact 400 remains open in the first switching position. A second outer end 402 of the rotatable knife contact 400 makes, in the second switching position, contact to the second fixed contact 200, whereby an electrical connection is formed between the second fixed contact 200 and the third fixed contact 300. A first outer end 401 of the rotatable knife contact 400 remains open in the second switching position. The outer ends 401, 402 ends of the rotatable knife contact 400 may thus be utilized alternatively in the switching operation.

The rotatable knife contact 400 may further have a zero position between the first and the second switching position in which the first, the second, and the third fixed contacts 100, 200, 300 are electrically isolated from each other.

The rotational axis Z1, Z2 of the rotatable knife contact 400 may be located at a middle portion of the blades 410, 420 in the rotatable knife contact 400. The opposite outer ends 401, 402 of the blades 410, 420 are thus free to make contact with the contact portion 120, 220 of the first and the second fixed contact 100, 200.

The rotational axis Z1, Z2 of the rotatable knife contact 400 may be located at the intersection of a center line X1-X1 passing in the height direction of the housing 10 and a longitudinal center line Y1-Y1 passing in the longitudinal direction of the housing 10. The rotational axis Z1-Z1 of the rotatable knife contact 400 extends in the embodiment of the figure perpendicularly to the plane of the paper i.e. perpendicular to the longitudinal direction Y-Y and perpendicular to the height direction X-X of the housing 10. The rotatable knife contact 400 may be supported on a roller 80 positioned within the housing 10. The roller 80 may rotate around the rotational axis Z1, Z1 of the rotatable knife contact 400.

The housing 10 may comprise a first chamber 13A and a second chamber 13B. The first chamber 13A and the second chamber 13B may be on opposite sides of the longitudinal center line Y1-Y1 of the housing 10. The contact portion 120 of the first fixed contact 100 and a first arc extinguishing apparatus 14A may be positioned in the first chamber 13A. The contact portion 220 of the second fixed contact 200 and a second arc extinguishing apparatus 14B may be positioned in the second chamber 13B. The first end 401 of the blade pair of the rotatable knife contact 400 may, in a switching event, move within the first chamber 13A and the second end 402 of the blade pair may, in a switching event, move within the second chamber 13B.

When the first end 401 of the blades 410, 420 of the rotatable knife contact 400, after having been in contact with the contact portion 120 of the first fixed contact 100, rotates counterclockwise, the contact between the blades of the rotatable knife contact 400 and the contact portion 120 of the first fixed contact 100 is disconnected and an arc illuminates between them through the gas (air) in the interior of the housing 10. This arc is cut off when the blade pair 410, 420 passes through the first arc extinguishing apparatus 14A.

When the second end 402 of the blades 410, 420 of the rotatable knife contact 400, after having been in contact with the contact portion 220 of the second fixed contact 200 rotates clockwise, the contact between the blades of the rotatable knife contact 400 and the contact portion 220 of the second fixed contact 200 is disconnected and an arc illuminates between them through the gas (air) in the interior of the housing 10. This arc is cut off when the pair of blades 410, 420 passes through the second arc extinguishing apparatus 14B.

The first and second arc extinguishing apparatus 14A, 14B may be formed of plates 15A, 15B being vertical in view of the plane of the figure and extending in the thickness direction Z-Z of the housing 10. Each plate 15A, 15B may be provided with a slit in which the end 401, 402 of the pair of blades can pass during a switching event. The plates 15A, 15B may extend substantially in the radial direction relative to the rotational axis Z1-Z1 of the rotatable knife contact 400. The plates 15A, 15B may be made of metal, preferably of steel.

The combustion gases generated by the arc may be driven out of the housing 10 through the first chamber 13A or the second chamber 13B and finally through a first exhaust opening 18A or a second exhaust opening 18B in the second side wall 10B of the housing 10. The combustion gases may mainly discharge from the region of the first contact portion 120 of the first fixed contact 100 within the first chamber 13A towards the third side wall 10C of the housing 10. The combustion gases may pass through a first discharge channel provided in the first chamber 13A between the third side wall 10C of the housing 10 and an outer perimeter of the first extinguishing apparatus 14A and further via an outward portion of the first chamber 13A to the first exhaust opening 18A. The combustion gases may be discharged in a corresponding manner mainly from the region of the contact portion 220 of the second fixed contact 200 within the second chamber 13B towards the fourth side wall 10D of the housing 10. The combustion gases may pass through a second discharge channel provided in the second chamber 13B between the fourth side wall 10D of the housing 10 and an outer perimeter of the second extinguishing apparatus 14B and further via an outward portion of the second chamber 13B to the second exhaust opening 18A.

The combustion gases may be driven out of the housing 10 through the exhaust openings 18A, 18B in the second side wall 10B of the housing 10, i.e. the combustion gases may be directed to the same side of the housing 10 where the third fixed contact 300 is located. A possible deposition of conductive particles in the combustion gases on the second side wall 10B of the housing 10 cannot make a short circuit between two fixed contacts, since this second side wall 10B of the housing 10 is provided with only one fixed contact, i.e. the third fixed contact 300.

The housing 10 may also comprise two stoppers 16A, 16B limiting the rotational movement of the rotatable knife contact 400. When the rotatable knife contact 400 is turned clockwise into the first contact position, the first end 401 of the rotatable knife contact 400 may come into contact with the contact portion 120 of the first fixed contact 100. At the same time, the opposite second end 402 of the rotatable knife contact 400 may turn against a second stopper 16B which may stop the clockwise turn of rotatable knife contact 400. When the rotatable knife contact 400 is rotated counterclockwise into the second contact position, the second end 402 of the rotatable knife contact 400 may come into contact with the contact portion 220 of the second fixed contact 200. At the same time, the opposite first end 401 of the rotatable knife contact 400 may turn against a first stopper 16A which may stop the counterclockwise turn of the rotatable knife contact 400. These stoppers 16A, 16B may also limit the chambers 13A, 13B formed in the housing 10. The stoppers 16A, 16B may also protect the braided cables 31, 32 from the combustion gases and from metal vapor. There may further be walls 16C, 16D between the first and the second fixed contact 100, 200, which walls 16C, 16D may also limit the rotational movement of the rotatable knife contact 400.

The arc is an electrical discharge which is generated when the voltage between two contacts exceed the dielectric strength of the material (air) between the contacts. The resistance between the contacts increases when the contacts open and the contact pressure reduces resulting in an arc between the contacts. The contacts will thus heat up and a portion of the contact material may melt and eventually evaporate. The breakthrough occurs when the metal vapor and air molecules between the contacts break down into atoms and further into ions increasing the electrical conductivity of the gas. The arc may be extinguished by increasing the arc voltage, i.e. by transferring energy away from the arc. The energy of the arc may be reduced by prolonging, cooling or braking the arc with perpendicular extinguishing plates of metal.

FIG. 3 shows an exploded view of a rotatable knife contact and a roller of the electrical switch.

The rotatable knife contact 400 comprises, in this embodiment, a single blade pair formed of two longitudinal blades 410, 420.

The blades 410, 420 in the pair of blades may be attached to each other with a spring structure 460, 470. The spring structure 460, 470 may comprise a spring guide 461, 471, a spring 462, 472 and a tensing bar 480.

The spring guide 461, 471 may be formed of a longitudinal plate extending in the longitudinal direction of the blade 410, 420 and positioned against the outer surface of the blade 410, 420. Both ends of the plate may comprise arms 461A, 471A extending in a transverse direction over the edges of the blade 410, 420. The inner surface of the plate may comprise pins 461B, 471B that are seated in a groove 416, 426 in the outer surface of the blade 410, 420. The groove 416, 426 in the outer surface of the blade 410, 420 may be in the same position as the protrusion 415, 425 in the inner surface of the blade 410, 420, which is seen in FIG. 4. The groove 416, 426 and the protrusion 415, 425 may be made in one step by punching the blade 410, 420 from the outer surface. The pins 461B, 471B may lock the spring guide 461, 471 to the blade 410, 420 in the transverse direction of the blade 410, 420 and may allow a small movement in the longitudinal direction of the blade 410, 420.

The spring 462, 472 may be formed of a spring 462, 472 extending in the longitudinal direction of the blade 410, 420 and being adapted into the outer surface of the spring guide 461, 471. Opposite ends of the spring 462, 472 may comprise a groove 462A, 472A having the form of a half circle and being seated against a pin 461C, 471C protruding from the outer surface of the spring guide 461, 471. A middle portion of the spring 462, 472 may comprise a groove 462B, 472B, which may receive a tensing bar 480.

The pins 461B, 471B in the inner surface of the spring guide 461, 471 and the pins 461C, 471C in the outer surface of the spring guide 461, 471 may be made by punching from the opposite side of the spring guide 461, 471.

The tensing bar 480 may be formed of a U-formed piece, which may compress the blades 410, 420 together at a desired force. The pressing force of the tensing bar 480 may be adjusted by changing the dimensions of the tensing bar 480. The tensing bar 480 may extend over one edge of the blades 410, 420. The cross section of the tensing bar 480 may be round and it may extend in a transverse direction in view of the longitudinal direction of the blade pair 410, 420. The tensing bar 480 may be positioned substantially at a longitudinal middle point of the blades 410, 420.

The figure shows also the protrusions 83, 84 protruding from the cylindrical portion 85 of the roller 80, which protrusions 83, 84 support the pair of blades in the roller 80. One of the protrusions 83 is formed of a separate part, which is pushed with the blade pair into the roller 80. This removable protrusion 83 may be attached to the roller 80 with quick coupling means. The figure shows further the third fixed contact 300 and the braided cable 31 with which the third fixed contact 300 is connected to the rotatable knife contact 400.

The magnetic field caused by a current passing in the same direction in each blade 410, 420 in the rotatable knife contact 400 will produce a force between the blades 410, 420. The force will pull the blades 410, 420 towards each other. The spring guides 461, 471 will restrict the leakage of the magnetic field from the blades 410, 420, whereby a strong magnetic field is maintained between the blades 410, 420 especially in a short circuit situation with strong currents. The spring guides 461, 471 are of metal, preferably of steel.

FIG. 4 shows a rotatable knife contact of the electrical switch.

The rotatable knife contact 400 comprises at least one pair of blades 410, 420. Each blade 410, 420 may be formed as one single piece. Each blade 410, 420 may be formed of a substantially straight solid bar having a length, a width and a thickness. The bar may have a substantially rectangular cross section. The length of the blade 410, 420 may correspond to the length of the rotatable knife contact 400. The protrusion 415, 425 in the middle portion of the blade 410, 420 may then be made by punching the bar from the opposite side.

Each blade 410, 420 in the pair of blades may comprise a protruded middle portion 415, 425. The protruded middle portions 415, 425 may seat against each other when the blades 410, 420 are connected to each other. The blades 410, 420 in the pair of blades may thus become supported at each other through the protruded middle portions 415, 425. The width of the protruded middle portion 415, 425 may be only a portion of the width of the blade 410, 420.

The blades 410, 420 in the rotatable knife contact 400 may comprise two opposite outer ends 401, 402. A first contact gap Al may be formed between the two opposite blades 410, 420 at the first end 401 of the blades 401, 402 and a second contact gap A2 may be formed between the two opposite blades 410, 420 at the second end 402 of the blades 401, 402.

The two blades 410, 420 in each pair of blades may be flexibly supported at each other with the spring structure 460, 470 described earlier. Due to the flexible support of the blades 410, 420, the blades 410, 420 may when a separating force F1, F2 is acting on either end 401, 402 of the blades 410, 420, take a V-shape. When the distance between the blades 410, 420 in the first end 401 of the pair of blades is increased, then the distance between the blades 410, 420 at the second end 402 of the pair of blades will decrease and vice a versa. The separating force F1, F2 may be caused by the contact portion 120, 220 of the first and the second fixed contacts 100, 200 penetrating into the contact gap A1, A2 between the ends 401, 402 of the blades 410, 420.

The protruded middle portions 415, 425 of the blades 410, 420 may act as a sort of a pivot point P1, P2 between the blades 410, 420. The pivot points P1, P2 may be formed at opposite longitudinal ends of the protruded middle portions 415, 425 of the blades 410, 420.

A separating force F1, F2 acting between the blades 410, 420 at the first end 401 of the pair of blades may result in pivoting of the blades 410, 420 around the second pivot point P2. The distance between the blades 410, 420 at the first end 401 increases and the distance between the blades 410, 420 at the second end 402 decreases. A separating force F1, F2 acting between the blades 410, 420 at the second end 402 of the pair of blades may result in pivoting of the blades 410, 420 around the first pivot point P1. The distance between the blades 410, 420 at the second end 402 increases and the distance between the blades 410, 420 at the first end 401 decreases.

The spring structure 460, 470 may produce a counter force to the separating force F1, F2 so that the blades 410, 420 may be returned to a substantially parallel position when no separating force F1, F2 is acting on the blades 410, 420 in either end 401, 402 of the pair of blades.

The blades 410, 420 may, in a non-deflected situation, rotate in parallel planes. The figure shows a central rotation plane X1-X1 between the blades 410, 420.

FIG. 5 shows a rotatable knife contact and a roller of the electrical switch.

The blades 410, 420 in the pair of blades in the rotatable knife contact 400 may be supported on a cylinder-like roller 80 so that opposing ends 401, 402 of the rotatable knife contact 400, which also constitute the opposing ends of the blade pair 410, 420, protrude from the roller 80. The roller 80 may comprise a cylindrical portion 85 provided with two side protrusions 83, 84 extending radially outwards in opposite directions from the cylindrical portion 85. A center axis of the two side protrusions 83, 84 pass through the rotational axis Z1-Z1 of the roller 80. Each of the two side protrusions 83, 84 may comprise two spaced apart walls extending perpendicular to the rotational axis Z1, Z1 of the roller 80. A first edge of the walls in each side protrusion 83, 84 may comprise a guide part perpendicular to the wall. The guide parts may extend from the edge of the wall towards each other and terminate at a distance from each other. There are no guide parts in the second opposite edge of the walls in each side protrusion 83, 84. A first edge of each blade 410, 420 in the rotatable knife contact 400 may be supported on a respective guide part in the side portions 83, 84 of the roller 80. A second opposite edge of each blades 410, 420 in the rotatable knife contact 400 is thus free. The free edge of the blades 410, 420 faces towards the conduct portions 120, 220 of the first and second fixed contact 100, 200. The contact portion 120, 220 can thus be received between the blades 410, 420 from the free edge of the blades 410, 420. The pair of blades 401, 420 is centralized in the roller 80 with stoppers 87A, 87B in the roller 80.

The roller 80 that is positioned within the housing 10 may be rotatable in respect of the housing 10. The roller 80 may comprise an end portion 81, 82 at each longitudinal opposite end of the roller 80. Each end portion 81, 82 of the roller 80 may be supported in a circular opening 19 formed in each side panel 10E, 10F of the housing 10. The end portions 81, 82 of the roller 80 rotate against the circumference of the circular opening 19 in each side panel 10E, 10F of the housing 10. The rotatable knife contact 400 thus rotates with the roller 80 around the rotational axis Z1-Z1 directed in the thickness direction Z-Z of the housing 10.

FIG. 6 shows a fixed contact of the electrical switch.

The first and second fixed contacts 100, 200 may be identical or mirror images of each other. The contact portion 120, 220 of the first and second fixed contacts 100, 200 may be formed as a plate-like piece. In this embodiment, the contact portion 120, 220 of the fixed contact 100, 200 is formed of two similar, spaced apart branches. The connection portion 110, 210 of the first and the second fixed contact 100, 200 may terminate in a U-shaped portion extending in a direction perpendicular to the longitudinal direction of the connection portion 110, 210. Each branch of the U-shaped portion may comprise the actual contact portion 120, 220, which in a switching event may seat between the blades 410, 420 of the moving contact 400. The contact portion 120, 220 in each branch may receive one blade pair 410, 420 of the rotatable knife contact 400. The fixed contact 100, 200 in the figures is aimed to work with such a rotatable knife contact 400, which has two parallel pairs of blades 410, 420. The contact portion 120, 220 of each branch of the fixed contact 100, 200 may, in a switching event, seat between one pair of blades 410, 420.

The opposite surfaces in each branch of the contact portions 120, 220 of the first and the second fixed contact 100, 200 may comprise a roughened area 130, 230. The roughened area 130, 230 may drag against the inner surface of the blades 410, 420 of the knife contact 400 in a switching event. The contact portions 120, 220 may become sooty in the switching event, which may increase the contact resistance and the heating of the contacts.

Each branch of the contact portions 120, 220 of the first and the second fixed contact 100, 200 may further comprise a first contact pin 140, 240. The first contact pin 140, 240 may extend only along a portion of the area of the contact portion 120, 220. The first contact pin 140, 240 may extend on the opposite contact surfaces of the contact portion 120, 220. The first contact pin 140, 240 may also extend over a front edge 155, 255 of the contact portion 120, 220. The first contact pin 140, 240 may be positioned in a recess in the contact portion 120, 220. The first contact pin 140, 240 may be firmly attached in the recess to the contact portion 120, 220. The material of the first contact pin 140, 240 may be selected so that it withstands the erosion of the arc better than the actual contact portion 120, 220. The first contact pin 140, 240 may protect the actual contact portions 120, 220 from the wearing effect of the arc and may thereby increase the lifetime of the contacts in the electrical switch.

Each branch of the contact portions 120, 220 of the first and the second fixed contact 100, 200 may further comprise a protruded nose 150, 250. The protruded nose 150, 250 may be positioned in a front edge 155, 255 of the contact portion 120, 220 and it will make the initial contact with the blade 410, 420 of the knife contact 400 when the knife contact 400 is closed. The protruded nose 150, 250 may protect the contact portion 120, 220 when the rotatable knife contact 400 is closed in a short circuit situation i.e. the output of the electrical switch 500 is short circuited. A main portion of the short circuit current may pass through the protruded nose 150, 250. This may protect the contact pins 140, 240 in the contact portion 120, 220 from heating up too much. An excessive heating of the contact pins 140, 240 might cause melting of the soldering material of the contact pins 140, 240 resulting in disconnection of the contact pins 140, 240 from the contact portion 120, 220. The contact resistance and the resistivity of the contact pin 140, 240 may be higher than that of the contact portion 120, 220, which causes a greater heating of the contact pin 140, 240 especially when subjected to a high short circuit current. The contact oscillations are much smaller when the contact portion 120, 220 and the blades 410, 420 make contact compared to the situation when the contact pins 140, 240, 440 make contact. This is due to the fact that the contact pins 140, 240, 440 are much harder than the contact portion 120, 220 and the blades 410, 420. The contact oscillations generate arcs causing wear to the contact portions 120, 220 and the blades 410, 420 and this may result in that opposite contact surfaces weld to each other. Also some combination of materials have a tendency to weld to each other during a switching event.

The protruded nose 150, 250 which extends a little bit further outwards than the first contact pin 140, 240 will make the first contact with the blades 410, 420 when the rotatable knife contact 400 closes against the contact portion 120, 220 of the fixed contact 100, 200. The first contact may be established between the second contact pins 440 in the blades 410, 420 and the protruded nose 150, 250 in the contact portion 120, 220 of the fixed contact 100, 200 when the rotatable knife contact 400 closes.

FIG. 7 shows a blade of a rotatable knife contact of the electrical switch.

The opposite ends of the blade 410, 420 of the rotatable knife contact 400 may comprise contact portions 411, 421, 412, 422 through which the contact to the fixed contacts 100, 200 may be formed. An outwardly protruding area 430 may be provided on an inner surface of each blade 410, 420 at a distance from an outer tip of the blade 410, 420 in the pair of blades of the rotatable knife contact 400. The outwardly protruding area 430 at one end 401, 402 of the blades 410, 420 of the rotatable knife contact 400 will at the end of the switching event, when the rotatable knife contact 400 has reached its permanent contact position, seat on a corresponding roughened area 130, 230 of the contact portion 120, 220 of the corresponding fixed contact 100, 200. The other opposite end 401, 402 of the blades 410, 420 will be free.

The outwardly protruding areas 430 of the contact blades 410, 420 of the rotatable knife contact 400 may be positioned towards the edge 455 of the blade 410, 420 that will first become into contact with the first or second fixed contact 100, 200 in a switching situation. The sweep of the protruding areas 430 over the roughened areas 130, 230 of the contact portion 120, 220 of the corresponding fixed contact 100, 200 may thus become as long as possible in the switching event.

These outwardly protruding areas 430 of the blades 410, 420 of the rotatable knife contact 400 may pass over the roughened area 130, 230 of the fixed contact 100, 200 whenever the coupling is formed and cut off. The outwardly protruding areas 430 and the roughened areas 130, 230 remain thus clean. The roughened area 130, 230 also collects more silver and grease to the area and new silver is revealed when the roughened area 130, 230 wears.

Second contact pins 440 may be provided on the ends 401, 402 of the blades 410, 420 of the rotatable knife contacts 400. The second contact pin 440 may extend only along a portion of the area of the contact portions 411, 421, 412, 422 of the blade 410, 420 of the rotatable knife contact 400. The second contact pin 440 may extend on the opposite contact surfaces of the blades 410, 420. The second contact pin 440 may also extend over a front edge of the blade 410, 420. The second contact pin 440 may be positioned in a recess in the blade 410, 420. The second contact pin 440 may be firmly attached in the recess to the blade 410, 420. The material of the second contact pin 440 may be such that it withstands the erosion of the arc better than the rest of the blade 410, 420. The second contact pin 440 may protect the blade 410, 420 from the wearing effect of the arc and may thereby increase the lifetime of the contacts in the electrical switch. The second contact pin 440 may pass over the first contact pin 140, 240 in a switching event. The second contact pin 440 may overlap only partly the first contact pin 140, 240 when passing over the first contact pin 140, 240 in a switching event. The second contact pin 440 may not necessary make direct contact with the first contact pin 140, 240 in a situation in which the contact pins 140, 240, 440 are slightly below the outer surface of the contact.

The outwardly protruding areas 430 of the blades 410, 420 may produce a separating force F1, F2 between the blades 410, 420 in the pair of blades when the contact portion 120, 220 of the fixed contact 100, 200 is received between the blades 410, 420. The flexible support of the blades 410, 420 to each other will result in the V-shape of the blades. The ends 401, 402 of the blades 410, 420 that extend beyond the outwardly protruding areas 430 will thus be separated from the contact portion 120, 220 of the fixed contacts 100, 200. Only the outwardly protruding areas 430 will make contact to the contact portion 120, 220 of the fixed contact 100, 200. The area for switching-on and switching-off and the area for nominal continuous current are separated in the blades 410, 420 of the rotatable knife contact 400 and in the contact portions 120, 200 of the first and second fixed contact 100, 200. The nominal continuous current flows through the outwardly protruding areas 430.

When closing the rotatable knife contact 400 to the first or to the second fixed contact 100, 200, the outer tip of the blades 410, 420 makes first contact with the contact portion 120, 200 of the fixed contact 100, 200. The contact area moves slightly towards the middle of the blades 410, 420 as the rotatable knife contact 400 turns further in the closing direction, whereby the tip of the blades 410, 420 loses contact with the fixed contacts 100, 200. The tip of the rotatable knife contact 400 wears when the rotatable knife contact 400 is closed and opened, whereby the base portion of the rotatable knife contact 400 is saved for conducting the nominal current.

The middle portion 450 of the blade 410, 420 and the protruded middle portions 415, 425 of the blades 410, 420 are also shown in the figure.

FIG. 8 shows a contact pin of a contact of the electrical switch.

The contact pin 140 shown in the figure may be used in the fixed contacts 100, 200 and in the rotatable knife contact 400. The first contact pins 140, 240 of the two fixed contacts 100, 200, and the second contact pins 440 of the rotatable knife contact 400 may thus be identical. The contact pin 140 preferably has a P-shape, thereby protecting the two sides of the contact 100, 200, 400. The contact pin 140 may comprise a front section 141 and a rear section 142. The contact pin 140 may further comprise a first inner surface 143A and a second inner surface 143B coming into contact with the recess in the contact 100, 200, 400. The contact pin 140 may further comprise a first outer surface 144A, a second outer surface 144B and a front surface 144C. The first and the second outer surfaces 144A, 144B may form contact surfaces to the opposite contact in a switching event. The arcs between the fixed contacts 100, 200 and the rotatable knife contact 400 may thus pass through opposite contact pins 140.

The contact pin 140 may be attached to the contact 100, 200, 400 from the inner surfaces 143A, 143B of the contact pin 140. The first inner surface 143A may have a rough structure in order to facilitate the fastening on the contact pin 140 to the contact 100, 200, 400. A soldering material may be applied on the inner surfaces 143A, 143B of the contact pin 140. The contact pin 140 may then be heated with welding, whereby a firm joint may be formed between the contact pin 140 and the contact 100, 200, 400. The first outer surface 144A may form a contact surface with the respective contact or blade surface of the contact. The second outer surface 144B may form a contact surface on the opposite surface of the contact or the blade.

The first and/or the second contact pin 140, 240, 440 may be positioned in the recess so that an outer surface of the contact pins 140, 240, 440 is substantially flush with the outer surface of the contact 100, 200, 400. This might be difficult to achieve due to manufacturing tolerances. The first and/or the second contact pin 140, 240, 440 may therefore be positioned in the recess so that the outer surface of the contact pin 140, 240, 440 is slightly below the outer surface of the contact 100, 200, 400. The slightly inward position of the contact pins 140, 240, 440 may be advantageous when the contact is closed in a short circuit situation. The first and/or the second contact pin 140, 240, 440 may on the other hand be positioned in the recess so that the outer surface of the contact pin 140, 240, 440 it is slightly above the outer surface of the contact 100, 200, 400. Such a slightly outward position might also work due to contact vibrations and a suitable form of the contact. The size of the nominal current of the electrical switch might also influence the choice between these three possibilities.

The first and/or the second contact pin 140, 240, 440 extend in the figures on both surfaces of the contact 100, 200, 400 and over the front edge 155, 255, 455 of the contact 100, 200, 400. This is an advantageous embodiment. The first and/or the second contact pin 140, 240, 440 could, however, instead extend only on one surface of the contact 140, 240, 440 or there could be contact pins 140, 240, 440 on both opposite surfaces of the contact 100, 200, 400 without a connection portion extending over the edge of the contact 100, 200, 400.

The first and/or the second contact pin 140, 240, 440 is in the figures shown as one entity. The first and/or the second contact pin 140, 240, 440 could, however, also be composed of several entities. Two or more contact pins could be positioned adjacent to each other in the recess or in adjacent recesses. The contact pin may thus be formed of two or more entities forming together the contact pin. The recess may have the form of a groove.

FIG. 9 shows a fixed contact and a rotatable knife contact of the electrical switch.

The figure shows the contact portion 220 of the second fixed contact 200 and a blade 410 in the rotatable knife contact 400. The blade 410 comprises a second contact pin 440 at each outer end of the blade 410 and a protruded area 430 at a distance from the outer tip of the blade 410. The protruded area 430 may be positioned radially inside the second contact pin 440 on the blade 410. The longitudinal center line Y1-Y1 and the transverse center line X1-X1 as well as the rotational axis Z1-Z1 of the blade 410 are shown in the figures. A circle having the rotational axis Z1-Z1 as center point and a radius extending to the middle of the second contact pin 440 is also shown in the figure.

The blade 410 is shown in solid lines in a neutral position B1, in dashed lines in an intermediate position B2, and in dashed lines in a final switching position B3.

The figure shows that the blade 410 may when it is turned counterclockwise, first make contact with the protruded nose 250 of the contact portion 220 in the front edge 255 of the contact portion 220. When the blade 410 is turned further counterclockwise, the second contact pin 440 will pass over the first contact pin 240. The second contact pin 440 and the first contact pin 240 may overlap each other only partly during the switching event i.e. they may not be fully aligned in respect of each other. The second contact pin 440 may or may not make a direct contact with the first pin 240 in the switching event depending on the position of the contact pins 240, 440 on the recesses. There may also be a direct contact beyond the contact pins 140, 240, 440 between the contacts 100, 200, 400 already at this stage. This may reduce the contact resistance and thereby the thermal stress on the contact pins 140, 240, 440. This may reduce the risk of the contact pins 140, 240, 440 becoming detached from the contacts 100, 200, 440.

The outer end portions of the blades 410, 420 containing the second contact pins 440 may be lifted from the surface of the contact portion 120, 220 of the first and second fixed contact 100, 200 immediately when the protruded portion 430 of the blade 410, 420 makes contact with the contact portion 120, 220 of the first and second fixed contact 100, 200.

In the final position B3 of the blade 410, the contact between the blade 410 and the contact portion 220 may be established only through the protruded area 430 on the blade 410 and the roughened area 230 on the contact portion 220. There is no contact between the first contact pin 240 and the second contact pin 440 in this position. The outer end portion of the blades 410, 420 of the rotatable knife contact 400 may thus be out of contact with the contact portion 120, 220 of the first and the second fixed contact 100, 200.

The contact points between the blade 410 and the contact portion 220 are opened in the reverse order when the contact opens i.e. the blade 410 is turned clockwise from the contact portion 220. The arc may start between the protruded nose 250 and the rotatable knife contact 400, but it may quickly move outwards between the first and the second contact pins 140, 240, 440. This is due to current forces in the arc and magnetic forces caused by the extinction plates 15A, 15B.

The first and second fixed contacts 100, 200 are located in the housing 10 as shown in FIG. 2. A center plane of the contact portions 120, 220 may coincide with a center plane positioned in the center between the blades 410, 420 of the rotatable knife contact 400.

The first contact pins 140, 240 and the second contacts pins 440 may act together. The arc may be mainly directed through the first contact pins 140, 240 and the second contact pins 440 when the rotatable knife contact 400 is opened.

A continuous contact between the rotatable knife contact 400 and the first or second fixed contact 100, 200 may be achieved through the roughened area 130, 230 on the opposite surfaces of the contact portion 120, 200 of the first or the second fixed contact 100, 200 and the outwardly protruding areas 430 on the inner surface of the blades 410, 420 of the rotatable knife contact 400. At this end position there are no longer any contact between the first contact pin 140, 240 of the first or second fixed contact 100, 200 and the second contact pin 440 of the rotatable knife contact 400.

FIG. 10 shows a non-modular three phase electrical switch.

All three phases may be positioned adjacent to each other in a common casing 50 comprising two halves 50U, 50L. The casing 50 may be divided with intermediate walls 51 into three compartments, whereby each compartment may form a housing 10. Each compartment i.e. each housing 10 may comprise a roller 80 and a rotatable knife contact 400. The first fixed contact 100 may be positioned in the upper half 50U of the casing 50 and the second fixed contact 200 may be positioned in the lower half 50L of the casing 50. The third fixed contact 300 may be L-shaped, whereby the vertical branch may protrude from the casing 50 through the junction between the upper half 50U and the lower half 50L of the casing 50. The rollers 80 may be connected to each other through the intermediate walls 51 in the casing 50. The invention may also be applied to such a non-modular electrical switch.

In the embodiment in the figures, the roughened areas 130, 230 are positioned on the outer surfaces of the contact portions 120, 220 of the first and the second fixed contact 100, 200 and the outwardly protruding areas 430 are positioned on the inner surface of the ends 401, 402 of the blades 410, 420 of the rotatable knife contact 400. The situation could also be reversed. The outwardly protruding areas would then be positioned on the outer surfaces of the contact portions 120, 220 of the first and the second fixed contact 100, 200. The roughened area would in a corresponding way be positioned on the inner surface of the blades 410, 420 of the rotatable knife contact 400.

The roughened area 130, 230 may be formed of a raster crossing extending outwards or inwards from the surface on which the roughened area is formed. The outwardly protruding area 430 may have a spherical form.

In an embodiment in which the rotatable knife contact 400 comprises only one pair of blades 410, 420, only one branch is needed in the contact portion 120, 220 of the first and second fixed contacts 100, 200. This single branch forms a shaped sheet like part seating between the pair of blades 410, 420. The upper blade 410 forms contact with an upper surface of the contact portion 120, 220 and the lower blade 420 forms contact with the opposite lower surface of the contact portion 120, 220.

The amount of blade pairs 410, 420 in the rotatable knife contact 400 may be increased in a situation where a greater current-carrying capacity through the electrical switch 500 is required. The blade pairs 410, 420 may be superimposed on each other in the roll 80. The blade pairs 410, 420 will then act synchronously with respect to each other, i.e., the superimposed blade pairs 410, 420 are parallel.

In a situation where the rotatable knife contact 400 comprises two superimposed blade pairs 410, 420, the contact portion 120, 220 of the first and second fixed contacts 100, 200 may comprise a bifurcated structure in which each branch is plate-like. A lower blade pair 410, 420 of the rotatable knife contact 400 may receive the lower branch of the contact portion 120, 220 of the first or the second fixed contact 100, 200. An upper blade pair 410, 420 of the rotatable knife contact 400 may receive the upper branch of the contact portion 120, 220 of the first or the second fixed contact 100, 200. The contact surface between the contact portions 120, 220 of the first and the second fixed contacts 100, 200 and the rotatable knife contact 400 may thus be increased, whereby the current-carrying capacity may be increased.

The electrical switch 500 shown in the figures is intended for relatively high currents. The third fixed contact 300 is therefore formed of two L-shaped bodies 310, 320. The current is thus distributed from the middle portion 450 of the rotatable knife contact 400 to each of the braided cables 31, 32 and further to each of the L-shaped bodies 310, 320 of the third fixed contact 300.

The third fixed contact 300 may instead of two single L-shaped bodies 310, 320 be made of a single T-shaped body. The third fixed contact 300 can also instead of two L-shaped bodies 310, 320 be made of only one L-shaped body 310, 320. Either of the two bodies 310, 320 shown in the figure could be used, but the second 320 is preferable due to the measurement opening 17 being positioned in connection with the horizontal branch 312 of the second body 320.

The first and the second fixed contact 100, 200 as well as the blades 410, 420 of the rotatable knife contact 400 are formed of a first electrically conductive material composition. The first and the second contact pins 140, 240, 440 are formed of a second electrically conductive material composition.

The second material composition may be different from the first material composition.

The second material composition may comprise at least one material that has a higher resistivity to the wearing effect of an arc acting between the fixed contacts and the rotatable knife contact in a switching event compared to any of the materials in the first material composition.

The housing 10 and the roller 80 of the electric switch 500 may be made of an electrically insulating material, e.g., of plastic.

The first, second and the third fixed contact 100, 200, 300 as well as the rotatable knife contact 400 may be of electrically conductive material, e.g. pure copper (Cu). The copper in these contacts may be coated with silver (Ag). The silver coating may reduce the contact resistance and protect the copper from oxidation. Copper and silver may form the first material composition.

The copper in the third fixed contact 300 may be coated with tin (Sn). Tin is cheaper than silver and there is no need for the low contact resistance provided by silver in the third fixed contact 300. The third fixed contact 300 is continuously connected to the rotatable knife contact 400. Tin may also function as an intermediate material when the braided cables 31, 32 are welded to the third fixed contact 300.

The first braided cable 31 and the second braided cable 32 may also be of electrically conductive material, e.g. copper. The braided cables 31, 32 can be made of very thin strands so that the braided cables become elastic. Each horizontal arm 311, 321 of the third fixed contact 300 may be coupled with one or several braided cables to the middle portion 450 of the rotatable knife contact 400. The braided cable 31, 32 becomes elastic when the thickness thereof i.e. the number of strands therein is not too high. The braided cable 31, 32 must, however, have a certain cross section area in order to have a sufficient current-carrying capacity. By using very thin strands, a smooth movement is achieved, but the number of strands increases.

The contact pins 140, 240, 440 may be of copper-tungsten e.g. 25% copper and 75% tungsten (Cu/W). The contact pins 140, 240, 440 may have a high thermal conductivity and the thermal properties may be such that melting and vaporizing of the material requires a lot of thermal energy. Copper-tungsten withstands the wearing effect of the arc better than silver. The contact resistance of copper-tungsten is higher than that of silver, but this is not critical in this application as the continuous contact in the end position of the rotatable knife contact 400 is not established through the contact pins 140, 240, 440. Copper and tungsten may form the second material composition.

The melting point of tungsten is more than three times higher than the melting point of copper and silver. The hardness of tungsten is more than two times the hardness of copper and silver.

The melting point of at least one material in the second material composition may be at least two times higher than the melting point of each of the materials in the first material composition. The melting point gives an indication of the materials suitability for the contact pins 140, 240, 440, but it is not the only decisive criteria. The ability of a material to withstand the wearing effect of the arc is a more complex question and it cannot be determined based on only one criteria. The second material composition should also be compatible with the first material composition.

Examples of other possible materials that may be used in the first and the second contact pins 140, 240, 440 are Copper-Tungsten (Cu/W), Silver-Tungsten (Ag/W), Silver-Tungsten Carbide (Ag/WC), Silver-Tungsten Carbide-Carbon (Ag/WC/C) and Silver-Molybdenum (Ag/Mo). The list contains only examples of suitable materials for the contact pins 140, 240, 440 i.e. it is by no means an exclusive list of possible materials.

A multiphase electrical switch may be formed by placing several electrical switches 500 together to form a modular package of electrical switches 500. The rotational axis Z1-Z1 of each rotatable knife contact 400 will coincide in such a solution. The electrical switches 500 may be connected to each other through the roller 80 of the rotatable knife contact 400. A first end of the roller 80 may extend at a distance from the surface plane of the housing 10, and the other opposite end of the roller 80 may substantially remain in the surface plane of the housing 10. The first end of the roller 80 may comprise a cylindrical outer end with a first tooth engagement on the outer circumference. The other end of the roller 80 may in a corresponding way comprise a cylindrical recess with a second tooth engagement on the periphery of the recess. When two adjacent electrical switches 500 are coupled together, the first protruding end of the roller 80 in the first electrical switch 500 is positioned in the second recess of the roller 80 of the second electrical switch 500 so that the teeth engage with each other. The rollers 80 of both electrical switches 500 are thus interconnected so that they rotate synchronously.

A multiphase electrical switch may on the other hand be formed in a common casing being divided with intermediate walls into adjacent housings 10 as shown in FIG. 10. The adjacent housings 10 form compartments in the casing. The rotational axis Z1-Z1 of each rotatable knife contact 400 may coincide also in such a solution.

An electrical switch 500 according to the invention may be an automatic electric switch, the fourth rotatable knife contact 400 being rotated through an actuator. The actuator may be, for example, a solenoid whose linear movement is converted into a rotational motion by means of a power transmission apparatus. The power transmission apparatus may rotate the roller 80 from the zero position clockwise or counterclockwise and thereby move the rotatable knife contact 400 between the contact positions. The actuator may also comprise a spring for returning the rotatable knife contact 400 to the zero position.

An electrical switch 500 according to the invention can act as a transfer switch e.g. in a hospital environment. In the hospital, there is a need to connect a load to a primary power supply or to a secondary power supply, whereby the primary power supply is an electrical network and the secondary power supply is a backup power plant. The load is thus coupled to the third fixed contact and the primary power source to the first or second fixed contact and the secondary power source correspondingly to the second or first fixed contact. Depending on the position of the electrical switch 500, the load can be supplied either from the electrical network or from the backup power supply. By connecting a sufficient number of electrical switches 500 in parallel, a multiphase transfer or changeover switch is provided. In a hospital, the load may be formed, for example, by the power needed in an operating room, where breaks in the power supply cannot be accepted.

The third fixed contact 300 is in the embodiment shown in the figures connected with one or several braided cables to the middle portion 450 of the rotatable knife contact 400. This is an advantageous solution. The third fixed contact 300 may, however, instead of braided cables be connected by a pivot connection to the middle portion 450 of the rotatable knife contact 400. The pivot connection in the rotatable knife contact 400 may be realized by attaching the pair of blades 410, 420 to each other with a shaft extending along the rotational axis Z1-Z1 of the blades 410, 420. The blades 410, 420 and the shaft form a fixed construction. A bushing is further arranged on the shaft, whereby the shaft and the blades 410, 420 are rotatable in respect of the bushing. The bushing may be provided with a connection protrusion extending perpendicular to the rotational axis Z1-Z1. The connection protrusion forms a middle portion 450 of the blades 410, 420. The third fixed contact 300 may extend from the opening 11C in the second side wall 10B of the housing 10 to the connection protrusion of the bushing i.e. the middle portion 450 of the blades 410, 420. The inner end of the third fixed contact 300 may be attached to the connection protrusion of the bushing with a pressure joint e.g. a bolt and a nut. The third fixed contact 300 may be straight in such an embodiment. The electrical contact is formed between the shaft and the interior of the bushing and/or between the blades 410, 420 and the ends of the bushing. The blades 410, 420 may be slightly flexible also in this solution allowing for the V-form. In a situation in which the rotatable knife contact 400 comprises several pairs of blades 410, 420, the bushing in each pair of blades 410, 420 may be coupled with a connection bar to the third fixed contact 300. The third fixed contact 300 may thus split into branches within the housing 10.

The blades 410, 420 in the rotatable knife contact 400 are in the embodiment shown in the figures connected flexibly to each other through pivot points P1, P2. Another possibility would be to connect the blades 410, 420 flexibly to each other so that the vertical distance between blades 410, 420 may change uniformly along the length of the blades 410, 420. The blades 420, 420 would thus move in parallel from each other and towards each other.

An electrical switch 500 according to the invention may be manufactured for a nominal current range of 100 to 1600 amperes.

The invention and its embodiments are not limited to the examples shown in the figures, but the invention may vary within the scope of the protection defined by the claims.

The invention claimed is:

1. An electrical switch comprising:

a first fixed contact, a second fixed contact, a rotatable knife contact having a rotational axis and comprising at least one longitudinal pair of blades flexibly connected to each other, wherein the blades form, in a switching event, contact with contact portions of the first and/or the second fixed contact, the rotational axis of the rotatable knife contact is positioned in a middle portion of the rotatable knife contact in respect of a longitudinal direction of the rotatable knife contact, a third fixed contact is positioned on an opposite side of the rotational axis of the rotatable knife contact in relation to the first and the second fixed contact being adjacent to each other, the rotatable knife contact is permanently electrically connected from the middle portion to the third fixed contact in all positions of the rotatable knife contact, wherein the rotatable knife contact is rotatable between a first switching position in which a first outer end of the rotatable knife contact makes contact to the first fixed contact so that an electrical contact is formed between the first fixed contact and the third fixed contact and a second switching position in which a second opposite outer end of the rotatable knife contact makes contact to the second fixed contact so that an electrical contact is formed between the second fixed contact and the third fixed contact.

2. The electrical switch according to claim 1, wherein the flexible connection between the blades in each pair of blades in the rotatable knife contact is realized through a pivot point formed between a middle portion of the blades allowing the blades to take a V-shape so that an increase of a distance between the first outer end of the blades leads to a decrease of a distance between the second outer end of the blades and vice a versa.

3. The electrical switch according to claim 2, wherein the pivot point is formed between two opposite, against each other seated protruded portions of the middle portion of each blade in the pair of blades, a spring construction being attached to an outer surface of each blade in the pair of blades in order to keep the blades substantially parallel when no force is acting on the blades.

4. The electrical switch according to claim 3, wherein an outwardly protruding area is provided on an inner surface of each blade at a distance from an outer tip of the blade in the pair of blades of the rotatable knife contact, or an outwardly protruding area is provided on opposite outer surfaces of the contact portion of the first and the second fixed contact.

5. The electrical switch according to claim 4, wherein a roughened area is provided on opposite outer surfaces of a connection portion of the first and the second fixed contact, or a roughened area is provided on the inner surface of each blade at a distance from an outer tip of the blade in the pair of blades of the rotatable knife contact, wherein a continuous contact between the rotatable knife contact and the first or the second fixed contact is formed through the roughened area and the outwardly protruding area at the end of the switching event.

6. The electrical switch according to claim 1, wherein a first contact pin is provided in the contact portion of the first and the second fixed contact, and a second contact pin is provided at outer ends of the blades in the pair of the blades of the rotatable knife contact, wherein the second contact pin passes over the first contact pin in the switching event.

7. The electrical switch according to claim 6, wherein the second contact pin and the first contact pin overlap each other only partly when the second contact pin passes over the first contact pin in the switching event.

8. The electrical switch according to claim 7, wherein the first and the second fixed contact as well as the blades in the rotatable knife contact are of a first electrically conductive material composition, the first and the second contact pin are of a second electrically conductive material composition, which is different from the first material composition.

9. The electrical switch according to claim 8, further comprising a housing, wherein the first, the second and the third fixed contact are fixedly arranged in the housing and the rotatable knife contact is arranged to be rotatable from a middle portion of the rotatable knife contact around the rotational axis in the housing.

10. The electrical switch according to claim 6, wherein the first and the second fixed contact as well as the blades in the rotatable knife contact are of a first electrically conductive material composition, the first and the second contact pin are of a second electrically conductive material composition, which is different from the first material composition.

11. The electrical switch according to claim 1, further comprising a housing, wherein the first, the second and the third fixed contact are fixedly arranged in the housing and the rotatable knife contact is arranged to be rotatable from the middle portion of the rotatable knife contact around the rotational axis in the housing.

12. The electrical switch according to claim 11, wherein the housing comprises a first side wall and a second side wall being opposite to and spaced apart from the first side wall in a longitudinal direction of the housing, a connection portion of the first and the second fixed contact passing through the first side wall and the third fixed contact passing through the second side wall.

13. The electrical switch according to claim 12, wherein the rotatable knife contact is supported on a rotatable roller, the roller comprising end portions being fitted into circular openings in the housing, wherein the roller and thereby also the rotatable knife contact become rotatable in respect of the housing.

14. The electrical switch according to claim 11, wherein the rotatable knife contact is supported on a rotatable roller, the roller comprising end portions being fitted into circular openings in the housing, wherein the roller and thereby also the rotatable knife contact become rotatable in respect of the housing.

15. The electrical switch according to claim 11, wherein the third fixed contact is formed of a T-shaped or at least one L-shaped body having a horizontal arm seated against an inner support surface in the housing, and a vertical arm protruding out from the housing.

16. The electrical switch according to claim 15, wherein the housing comprises a measurement aperture at a position of the horizontal arm of the third fixed contact, a temperature of the horizontal arm of the third fixed contact being measurable from an outside of the housing through said aperture.

17. The electrical switch according to claim 16, wherein the middle portion of the rotatable knife contact is connected to the horizontal arm of the third fixed contact with at least one flexible braided cable.

18. The electrical switch according to claim 15, wherein the middle portion of the rotatable knife contact is connected to the horizontal arm of the third fixed contact with at least one flexible braided cable.

19. The electrical switch according to claim 1, wherein the third fixed contact is connected with a pivot connection to the middle portion of the rotatable knife contact.

20. The electrical switch according to claim 1, wherein an outwardly protruding area is provided on an inner surface of each blade at a distance from an outer tip of the blade in the pair of blades of the rotatable knife contact, or an outwardly protruding area is provided on opposite outer surfaces of the contact portion of the first and the second fixed contact.

* * * * *